US011402137B2

(12) United States Patent
Yoshimi

(10) Patent No.: US 11,402,137 B2
(45) Date of Patent: Aug. 2, 2022

(54) REFRIGERANT AMOUNT MANAGEMENT SYSTEM

(71) Applicant: DAIKIN INDUSTRIES, LTD., Osaka (JP)

(72) Inventor: Manabu Yoshimi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/429,287

(22) PCT Filed: Feb. 5, 2020

(86) PCT No.: PCT/JP2020/004332
§ 371 (c)(1),
(2) Date: Aug. 6, 2021

(87) PCT Pub. No.: WO2020/166446
PCT Pub. Date: Aug. 20, 2020

(65) Prior Publication Data

US 2022/0065510 A1 Mar. 3, 2022

(30) Foreign Application Priority Data

Feb. 13, 2019 (JP) ..... JP2019-023526

(51) Int. Cl.
*F25B 45/00* (2006.01)
*F25B 49/02* (2006.01)

(52) U.S. Cl.
CPC ..... *F25B 45/00* (2013.01); *F25B 49/02* (2013.01); *F25B 2345/001* (2013.01);
(Continued)

(58) Field of Classification Search
CPC .... F25B 45/00; F25B 49/02; F25B 2345/001; F25B 2345/003; F25B 2345/006; F25B 2345/007; F25B 2600/05; F25B 2700/04
See application file for complete search history.

(56) References Cited

U.S. PATENT DOCUMENTS 4,856,288 A * 8/1989 Weber ..... G05D 9/12 62/129
2004/0055317 A1* 3/2004 Nomura ..... F25B 45/00 62/149

(Continued)

FOREIGN PATENT DOCUMENTS

EP 1 983 279 A1 10/2008
JP 2005-241172 A 9/2005

(Continued)

OTHER PUBLICATIONS

International Preliminary Report of corresponding PCT Application No. PCT/JP2020/004332 dated Aug. 26, 2021.

(Continued)

*Primary Examiner* — Jonathan Bradford
(74) *Attorney, Agent, or Firm* — Global IP Counselors, LLP

(57) ABSTRACT

A refrigerant amount management system manages an amount of refrigerant with which a plurality of refrigeration cycle apparatuses is filled. Each refrigeration cycle apparatus has a refrigerant circuit. The refrigerant amount management system includes an additional-filling-amount obtaining unit that obtains an additional filling amount of refrigerant with which a refrigeration cycle apparatus has been additionally filled after installation, a storage unit, and a useful-information creation unit. The storage unit stores apparatus information regarding the refrigeration cycle apparatus that has been additionally filled with refrigerant and the additional filling amount of the refrigeration cycle apparatus identified with the apparatus information in association with each other. The useful-information creation unit creates useful information to be used in management of the amount of refrigerant based on the additional filling amount of one of the refrigeration cycle apparatuses and the addi- (Continued)

tional filling amount of another of the refrigeration cycle apparatuses.

11 Claims, 7 Drawing Sheets

(52) U.S. Cl.
CPC ..... *F25B 2345/006* (2013.01); *F25B 2600/05* (2013.01); *F25B 2700/04* (2013.01)

(56) References Cited

U.S. PATENT DOCUMENTS

| | | | | |
|---|---|---|---|---|
| 2009/0126375 | A1* | 5/2009 | Toyoshima ..... | F25B 13/00 62/77 |
| 2011/0036104 | A1 | 2/2011 | Toyoshima et al. | |
| 2013/0205806 | A1* | 8/2013 | McMasters ..... | F25B 45/00 62/56 |
| 2014/0174114 | A1 | 6/2014 | Tamaki et al. | |
| 2018/0142928 | A1 | 5/2018 | Choi et al. | |

FOREIGN PATENT DOCUMENTS

| | | | |
|---|---|---|---|
| JP | 2011-85390 | A | 4/2011 |
| JP | 2014-16138 | A | 1/2014 |
| JP | 6312697 | B2 | 3/2018 |

OTHER PUBLICATIONS

International Search Report of corresponding PCT Application No. PCT/JP2020/004332 dated Apr. 7, 2020.
European Search Report of corresponding EP Application No. 20 75.5796.8 dated Feb. 22, 2022.

* cited by examiner

REFRIGERANT AMOUNT MANAGEMENT SYSTEM

CROSS-REFERENCE TO RELATED APPLICATIONS

This U.S. National stage application claims priority under 35 U.S.C. § 119(a) to Japanese Patent Application No. 2019-023526, filed in Japan on Feb. 13, 2019, the entire contents of which are hereby incorporated herein by reference.

BACKGROUND

Field of the Invention

The present disclosure relates to a refrigerant amount management system.

Background Information

As disclosed by, for example, Japanese Patent No. 6312697, a technique related to refrigerant filling support is available in the related art.

SUMMARY

Japanese Patent No. 6312697 discloses a technique related to refrigerant filling support but does not include an idea related to, for example, management of the amount of refrigerant that is actually supplied for additional filling at the site. Regarding, for example, a multi-air conditioner for buildings, a case is assumed where an outdoor unit that is filled in advance with refrigerant at a factory is additionally filled with refrigerant at the site at the time of construction or maintenance. In such a case, if the amount of refrigerant with which the outdoor unit has been additionally filled is not appropriate, for example, efficient operations may be hindered.

A refrigerant amount management system according to a first aspect manages the amount of refrigerant with which each of a plurality of refrigeration cycle apparatuses each having a refrigerant circuit is filled. The refrigerant amount management system includes an additional-filling-amount obtaining unit, a storage unit, and a useful-information creation unit. The additional-filling-amount obtaining unit obtains an additional filling amount. The additional filling amount is the amount of refrigerant with which a refrigeration cycle apparatus, among the refrigeration cycle apparatuses, after installation has been additionally filled. The storage unit stores apparatus information and the additional filling amount regarding a refrigeration cycle apparatus identified with the apparatus information in association with each other. The apparatus information is information regarding the refrigeration cycle apparatus that has been additionally filled with refrigerant. The useful-information creation unit creates useful information on the basis of the additional filling amount regarding one of the refrigeration cycle apparatuses and the additional filling amount regarding another of the refrigeration cycle apparatuses. The useful information is information to be used in management of the amount of refrigerant.

Accordingly, regarding additional filling of the refrigeration cycle apparatus with refrigerant performed at the construction site, it is possible to manage the additional filling amount of the refrigeration cycle apparatus. As a result, it is possible to determine whether the amount of refrigerant with which additional filling has been performed is appropriate.

The "useful information" here is not limited as long as the useful information is information used in management of the amount of refrigerant. For example, the "useful information" is information used by the administrator to determine whether the amount of refrigerant with which additional filling has been performed is appropriate. For example, the "useful information" is a report presented to the administrator regarding whether the amount of refrigerant with which additional filling has been performed is appropriate. Further, for example, the "useful information" is information indicating the average amount of refrigerant with which additional filling has been performed in a property similar to the refrigeration cycle apparatus that has been additionally filled with refrigerant and the like.

A refrigerant amount management system according to a second aspect is the refrigerant amount management system according to the first aspect and further includes an initial-filling-amount storage unit. The initial-filling-amount storage unit stores an initial filling amount regarding the refrigeration cycle apparatus. The initial filling amount is the amount of refrigerant before additional filling. Accordingly, it is possible to manage the additional filling amount in association with the initial filling amount.

A refrigerant amount management system according to a third aspect is the refrigerant amount management system according to the first or second aspect, in which the apparatus information includes information for identifying the installation environment of the refrigeration cycle apparatus that has been additionally filled with refrigerant. Accordingly, it is possible to manage the additional filling amount in association with the installation environment.

The "information for identifying the installation environment" here is not limited as long as the information for identifying the installation environment is information regarding the environment in which the refrigeration cycle apparatus that has been additionally filled with refrigerant is installed. For example, the "information for identifying the installation environment" is information regarding the property in which the refrigeration cycle apparatus that has been additionally filled with refrigerant is installed. For example, the "information for identifying the installation environment" is information for identifying at least any of the layout, the number of floors, the floor area, and the installation form of a refrigerant pipe in the installation place. Here, the "installation form of a refrigerant pipe" includes, for example, the length of a connection pipe that connects a heat source unit and a use unit and/or the level difference between the highest portion and the lowest portion of the connection pipe.

A refrigerant amount management system according to a fourth aspect is the refrigerant amount management system according to any of the first to third aspects, in which the apparatus information includes information for identifying the capacity of the connection pipe connected to the heat source unit of the refrigeration cycle apparatus that has been additionally filled with refrigerant and/or the specifics of the use unit of the refrigeration cycle apparatus that has been additionally filled with refrigerant. Here, the "specifics of the use unit" is at least any of, for example, the capacity (rated capacity) of the use unit, the air volume of a fan of the use unit, and the capacity of a heat exchanger of the use unit. Accordingly, it is possible to manage the additional filling amount in association with the capacity of the connection pipe connected to the heat source unit of the refrigeration cycle apparatus that has been additionally filled with refrigerant and/or the specifics of the use unit of the refrigeration cycle apparatus that has been additionally filled with refrigerant (for example, the capacity, the air volume, the capacity or form of the heat exchanger, and the like).

A refrigerant amount management system according to a fifth aspect is the refrigerant amount management system according to any of the first to fourth aspects, in which any or all of the additional-filling-amount obtaining unit, the storage unit, and the useful-information creation unit are disposed at a remote site away from the installation place of the refrigeration cycle apparatus. Accordingly, remote management is possible for the amount of refrigerant with which the refrigeration cycle apparatus has been additionally filled.

DETAILED DESCRIPTION OF EMBODIMENT(S)

Hereinafter, an embodiment of the present disclosure will be described. Note that the following embodiment is a specific example, is not intended to limit the technical scope, and can be changed as appropriate without departing from the spirit.

(1) Management System (Refrigerant Amount Management System)

Figure 1:
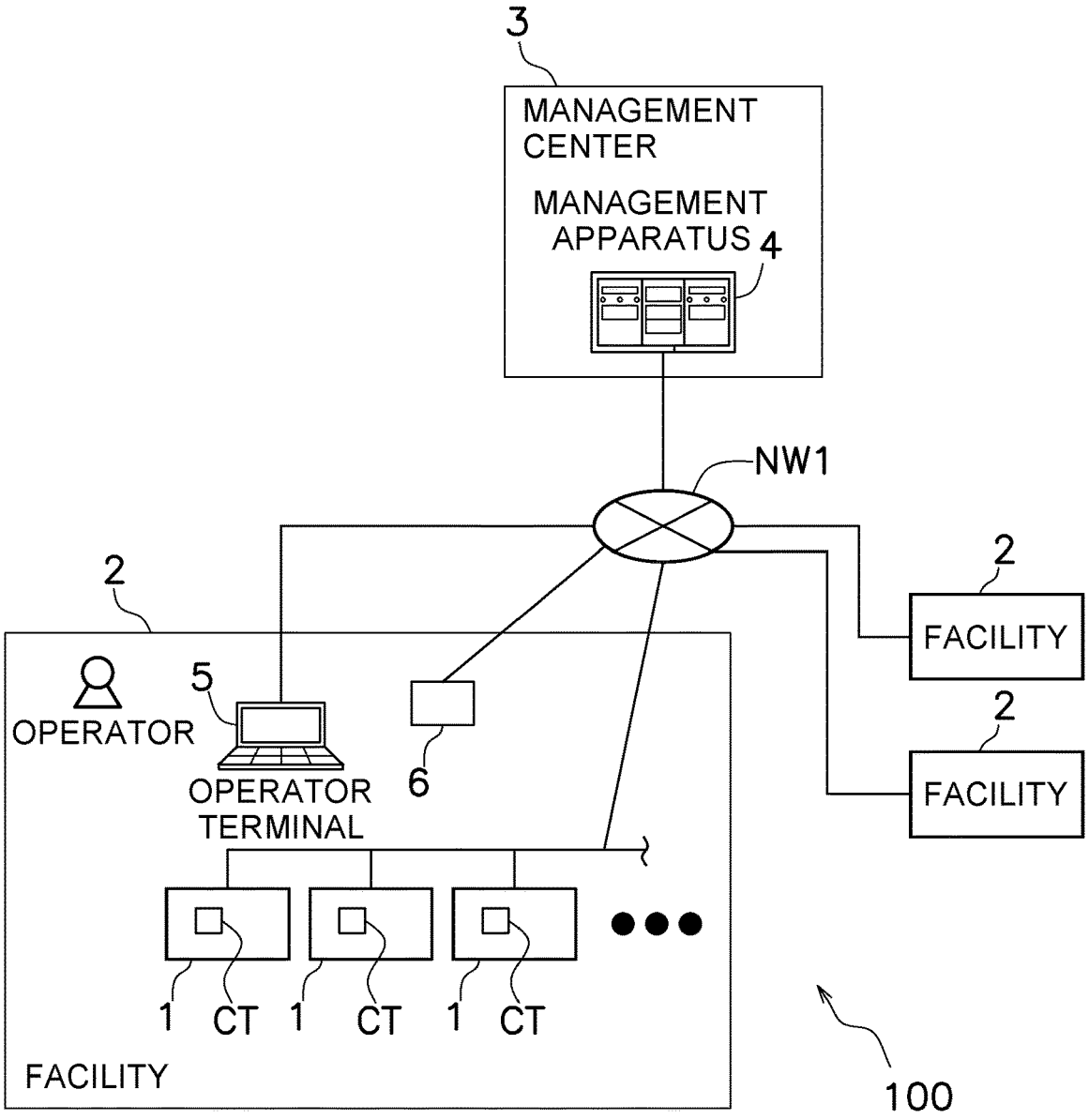
FIG. 1 is a schematic diagram illustrating a configuration form of a management system.
Figure 2:
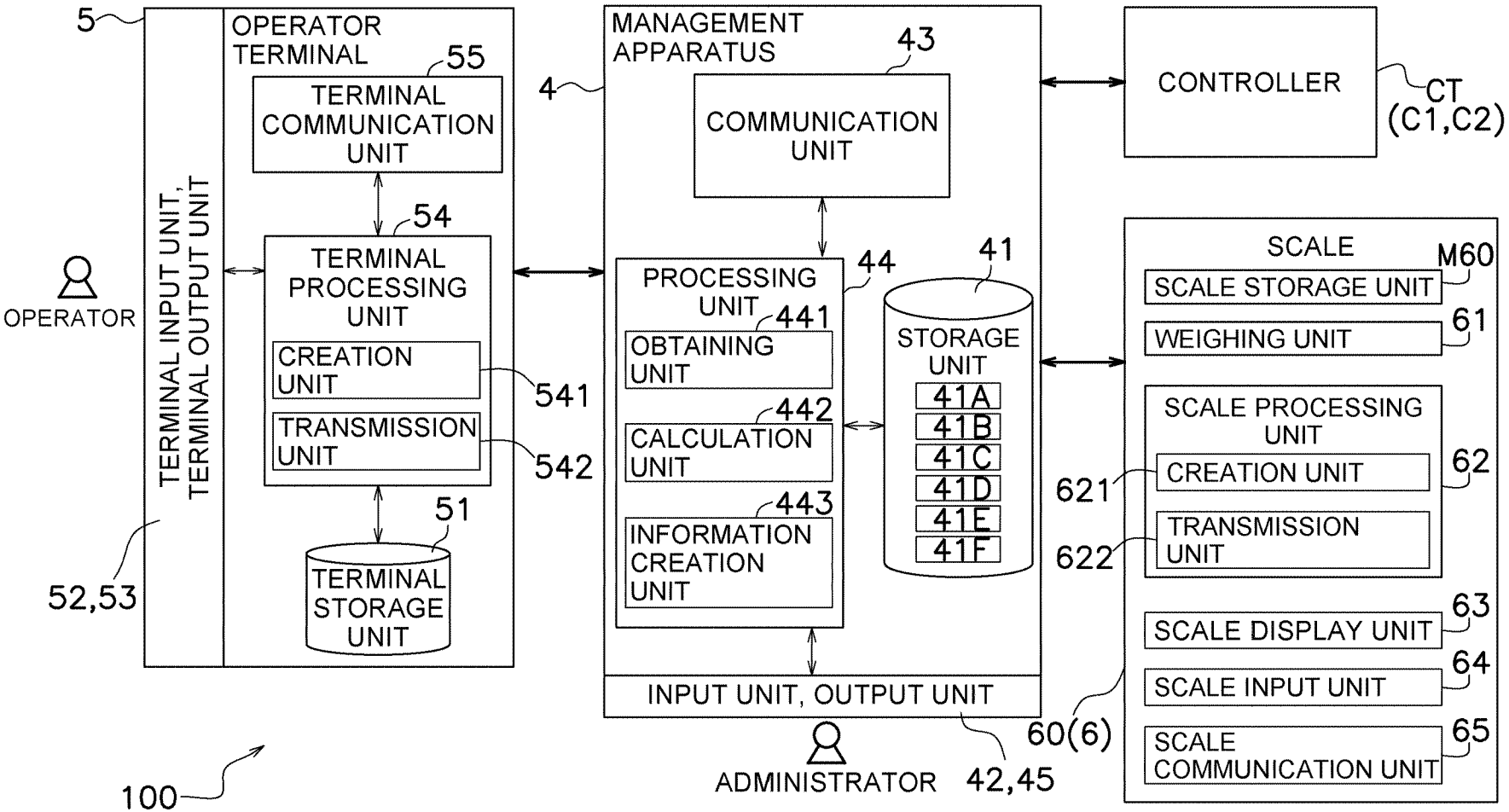
FIG. 2 is a block diagram illustrating an overall configuration of the management system.

FIG. 1 is a schematic diagram illustrating a configuration form of a management system 100. FIG. 2 is a block diagram illustrating an overall configuration of the management system 100.

The management system 100 is a system that manages, for a large number of refrigeration cycle apparatuses 1 including air conditioning apparatuses, chillers, dehumidifiers, water heaters, and the like each having a refrigerant circuit, the amount of refrigerant with which the refrigerant circuit is filled (refrigerant filling amount). Hereinafter, the amount of refrigerant with which each refrigeration cycle apparatus 1 is additionally filled is referred to as "additional filling amount". Note that "management" described here includes at least one of, for example, accumulation of information, use of information, creation of information, control of devices, and monitoring as to whether the additional filling amount is appropriate.

The management system 100 includes a management apparatus 4. The management apparatus 4 manages information regarding the refrigerant filling amounts of the plurality of refrigeration cycle apparatuses 1 that are management targets. The management apparatus 4 is installed in a management center 3. In the administration area of the management center 3, a large number of facilities 2 exist. The facilities 2 include, for example, office buildings, commercial buildings, and condominiums. In each facility 2, one or more refrigeration cycle apparatuses 1 are installed.

In the management system 100, the management apparatus 4 and devices including an operator terminal 5, a measuring device 6, and so on communicate with each other via a communication network NW1. The operator terminal 5 is an information processing device that is carried by an operator who fills each refrigeration cycle apparatus 1 with refrigerant. The operator terminal 5 is, for example, a laptop PC, a tablet PC, or a smartphone. The measuring device 6 is a device for measuring, when each refrigeration cycle apparatus 1 is additionally filled with refrigerant, the additional filling amount. Further, the management apparatus 4 communicates with each refrigeration cycle apparatus 1 via the communication network NW1. The management apparatus 4 obtains various types of information from devices such as the refrigeration cycle apparatuses 1, the operator terminal 5, and the measuring device 6 to thereby individually manage the refrigerant filling amounts, which are the amounts of refrigerant with which the respective refrigeration cycle apparatuses 1 are filled.

The communication network NW1 includes a Wide Area Network (WAN) that extends over a plurality of properties. For example, the communication network NW1 includes the Internet.

Note that the number of management apparatuses 4, the number of refrigeration cycle apparatuses 1, the number of operator terminals 5, and/or the number of measuring devices 6 can be changed as appropriate. Further, the number of facilities 2 and/or the number of management centers 3 can also be changed as appropriate.

(2) Refrigeration Cycle Apparatus

Figure 3:
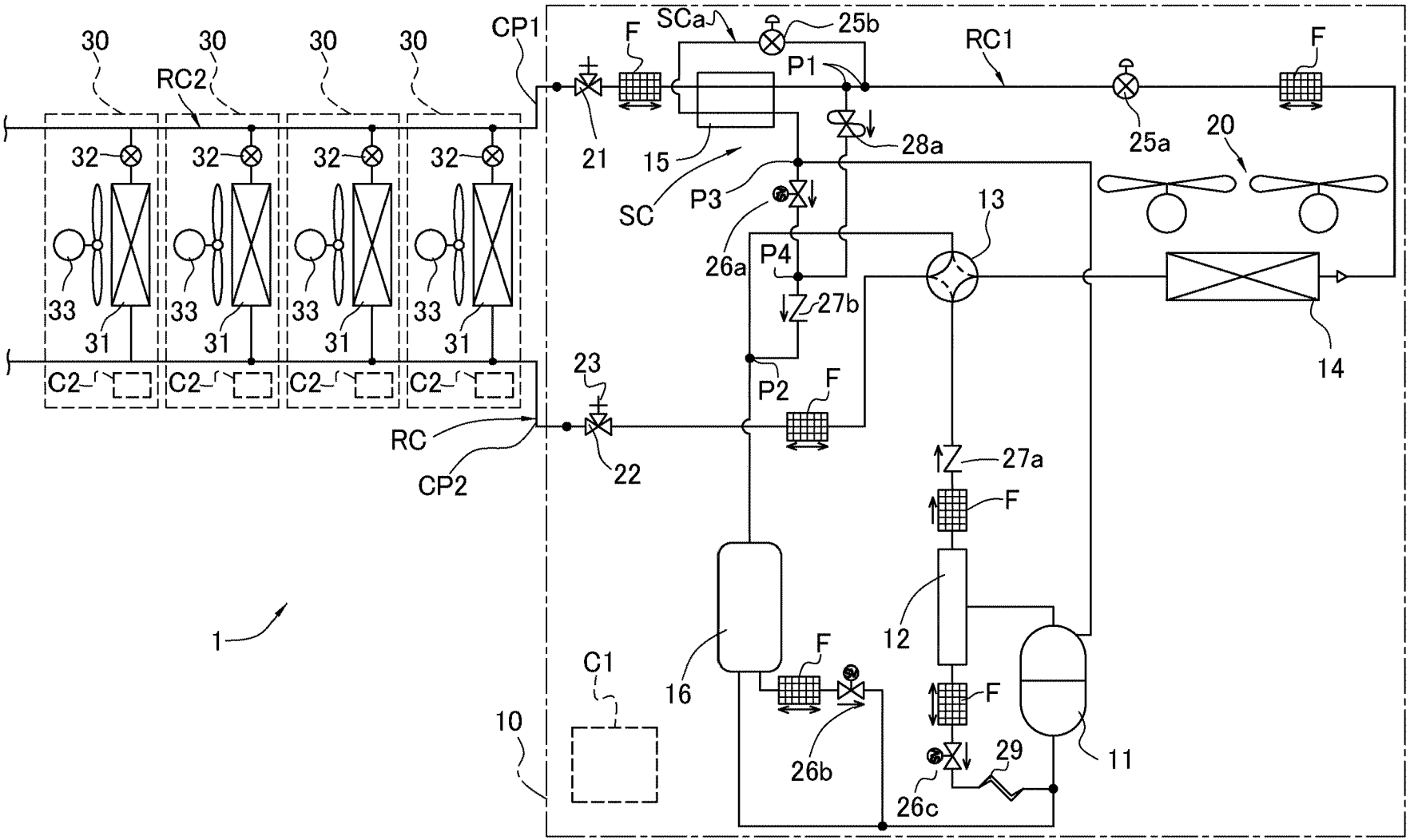
FIG. 3 is an overall configuration diagram of a refrigeration cycle apparatus.

Now, the refrigeration cycle apparatus 1 is described. As illustrated in FIG. 3, the refrigeration cycle apparatus 1 is an apparatus that performs a refrigeration cycle with refrigerant circulating through a refrigerant circuit RC. The refrigeration cycle apparatus 1 repeats a cycle that includes compression of refrigerant, heat release from refrigerant, decompression and expansion of refrigerant, and heat absorption into refrigerant. The refrigeration cycle apparatus 1 has a heat source unit 10, and a plurality of use units 30 that are connected to the heat source unit 10.

In a case where the heat source unit 10 is a heat source in which heat is released from refrigerant, each use unit 30 cools a target by using refrigerant absorbing heat. In a case where the heat source unit 10 is a heat source in which heat is absorbed into refrigerant, each use unit 30 heats a target by using refrigerant releasing heat.

The refrigeration cycle apparatus 1 is applicable to an air conditioning apparatus that performs cooling and heating and if this is the case, for example, the heat source unit 10 is an outdoor unit of the air conditioning apparatus and each use unit 30 is an indoor unit of the air conditioning apparatus. The use unit 30, which is an indoor unit, cools or heats air in an air conditioning target space to perform cooling or heating.

The refrigeration cycle apparatus 1 may be an apparatus other than an air conditioning apparatus. For example, the refrigeration cycle apparatus 1 may be a heat pump chiller, a heat pump water heater, or a refrigerator.

Figure 4:
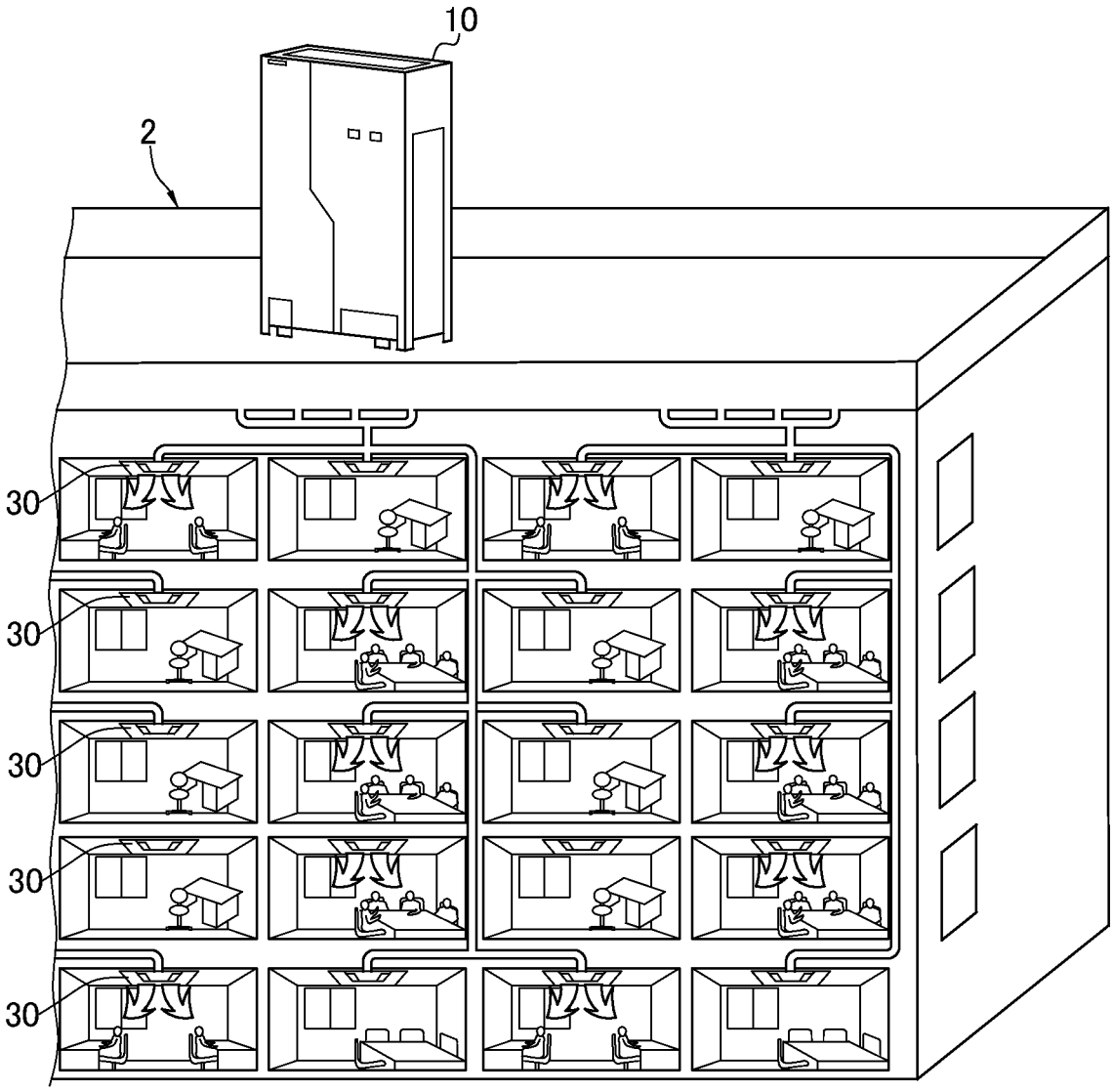
FIG. 4 is a schematic diagram illustrating an example where the refrigeration cycle apparatus is installed in a building.

FIG. 4 illustrates an example where the refrigeration cycle apparatus 1 is installed in the facility 2. In FIG. 4, the heat source unit 10 is installed on the rooftop of the facility 2. However, the form in which the heat source unit 10 is disposed is not limited to this and, for example, the heat source unit 10 may be disposed in, for example, a basement or a machine chamber. The plurality of use units 30 are installed in respective rooms to perform air conditioning of the rooms in the facility 2. Note that the number of heat source units 10 and/or the number of use units 30 included in the refrigeration cycle apparatus 1 are set as appropriate in accordance with the installation environment or engineering specifications. A plurality of heat source units 10 may be included in the refrigeration cycle apparatus 1.

The heat source unit 10 is filled with a predetermined amount (initial filling amount) of refrigerant at the time of shipment. In other words, when the refrigeration cycle apparatus 1 is installed, the heat source unit 10 is filled with refrigerant in an amount equivalent to the initial filling amount. Note that the initial filling amount is set as appropriate in accordance with the installation environment or engineering specifications.

The refrigeration cycle apparatus 1 is additionally filled with refrigerant when installed. The amount of refrigerant (additional filling amount) to be added after installation of the refrigeration cycle apparatus 1 is calculated as appropriate by using, for example, a predetermined calculation expression in accordance with, for example, the installation environment of the refrigeration cycle apparatus 1, the installation form of each use unit 30, and the installation form of connection pipes CP1 and CP2. The refrigeration cycle apparatus 1 is additionally filled with refrigerant by connecting the heat source unit 10 and a refrigerant container 80 by a charge hose 70.

In the refrigeration cycle apparatus 1, one heat source unit 10 and a plurality of use units 30 are connected by the connection pipes CP1 and CP2. In the refrigeration cycle apparatus 1, a heat-source-side circuit RC1 in the heat source unit 10 and a use-side circuit RC2 in the use units 30 are connected to each other to form the refrigerant circuit RC. In the refrigeration cycle apparatus 1, refrigerant circulates through the refrigerant circuit RC and a vapor compression refrigeration cycle is repeated accordingly.

(2-1) Heat Source Unit

The heat source unit 10 has a compressor 11, an oil separator 12, a four-way valve 13, a heat-source-side heat exchanger 14, a subcooling heat exchanger 15, an accumulator 16, a heat-source-side fan 20, a high-pressure-side shutoff valve 21, a low-pressure-side shutoff valve 22, a charge port 23, a first expansion valve 25*a* and a second expansion valve 25*b*, a first electromagnetic valve 26*a* to a third electromagnetic valve 26*c*, a first check valve 27*a* to a fourth check valve 27*d*, a first pressure regulating valve 28*a*, a capillary tube 29, and a plurality of filters F.

The heat-source-side heat exchanger 14 is, for example, a fin-and-tube heat exchanger and performs heat exchange between air and refrigerant. The subcooling heat exchanger 15 is, for example, a plate heat exchanger or a double-pipe heat exchanger. The first electromagnetic valve 26*a* to the third electromagnetic valve 26*c* open and close a refrigerant flow path. The first pressure regulating valve 28*a* maintains the pressure of refrigerant on the upstream side to a predetermined absolute value determined in advance. The arrow added to the first pressure regulating valve 28*a* points the downstream side of the first pressure regulating valve 28*a*. The filters F remove foreign matters from refrigerant that passes therethrough.

The discharge side of the compressor 11 is connected to the first port of the four-way valve 13 via the oil separator 12 and the first check valve 27*a*. Refrigerant discharged from the compressor 11 passes through the oil separator 12 in which oil is separated therefrom and flows toward the first port of the four-way valve 13. The second port of the four-way valve 13 is connected to one inlet-outlet of the heat-source-side heat exchanger 14, the third port of the four-way valve 13 is connected to the inlet of the accumulator 16, and the fourth port of the four-way valve 13 is connected to the low-pressure-side shutoff valve 22. In the four-way valve 13, the first port and the second port communicate with each other and the third port and the fourth port communicate with each other as represented by solid lines during a forward cycle operation, and the first port and the fourth port communicate with each other and the second port and the third port communicate with each other as represented by dashed lines during a reverse cycle operation.

The other inlet-outlet of the heat-source-side heat exchanger 14 is connected to one end of the first expansion valve 25*a* and is connected to the high-pressure-side shutoff valve 21 via the first expansion valve 25*a*. Between the other end of the first expansion valve 25*a* and the high-pressure-side shutoff valve 21, the subcooling heat exchanger 15 is disposed. The first expansion valve 25*a* is provided on the liquid side of the heat-source-side heat exchanger 14 to regulate the degree of decompression of refrigerant that passes therethrough. The subcooling heat exchanger 15, a subcooling circuit SCa, and the second expansion valve 25*b* constitute a subcooling portion SC. The subcooling circuit SCa branches off at a branch point P1 in a portion that extends from the other end of the first expansion valve 25*a* toward the high-pressure-side shutoff valve 21, passes through the subcooling heat exchanger 15, and comes to a junction point P2 between the four-way valve 13 and the accumulator 16. The second expansion valve 25*b* provided between the branch point P1 and the subcooling heat exchanger 15 regulates the degree of decompression of refrigerant that passes through the subcooling circuit SCa. The subcooling heat exchanger 15 causes heat exchange to be performed between refrigerant that flows between the branch point P1 and the high-pressure-side shutoff valve 21 and refrigerant that flows from the branch point P1 toward the junction point P2 in the subcooling circuit SCa.

In the subcooling circuit SCa, a branch point P3, the first electromagnetic valve 26*a*, a junction point P4, and the second check valve 27*b* are provided in this order from the subcooling heat exchanger 15 toward the junction point P2. The branch point P1 and the junction point P4 are connected to each other via the first pressure regulating valve 28*a*, and refrigerant flows from the branch point P1 toward the junction point P4. The branch point P3 is connected to the injection port of the compressor 11. In relation to this, refrigerant decompressed at the second expansion valve 25*b* and having an intermediate pressure exits from the subcooling heat exchanger 15, branches off upstream of the first electromagnetic valve 26*a*, and flows into the injection port of the compressor 11.

One outlet of the accumulator 16 is directly connected to the intake side of the compressor 11 in order to return gas refrigerant to the intake side of the compressor 11, and the other outlet of the accumulator 16 is connected to the intake side of the compressor 11 via the filter F and the second electromagnetic valve 26*b* in order to return oil. Between the intake side of the compressor 11 and the oil separator 12, a path that passes through the filter F, the third electromagnetic valve 26*c*, and the capillary tube 29 is formed in order to return separated oil to the compressor 11.

For the heat-source-side heat exchanger 14, the heat-source-side fan 20 is disposed. The heat-source-side fan 20 generates in the heat-source-side heat exchanger 14 an airflow for accelerating heat exchange.

The filter F is provided between the oil separator 12 and the first check valve 27*a*, between the heat-source-side heat exchanger 14 and the first expansion valve 25*a*, between the subcooling heat exchanger 15 and the high-pressure-side shutoff valve 21, between the fourth port of the four-way valve 13 and the low-pressure-side shutoff valve 22, between the other outlet of the accumulator 16 and the second electromagnetic valve 26*b*, and between the oil separator 12 and the third electromagnetic valve 26*c*.

The charge port 23 is provided at the low-pressure-side shutoff valve 22. To the charge port 23, the charge hose 70 for sending refrigerant from the refrigerant container 80 is connected at the time of filling with refrigerant. Note that the position where the charge port 23 is disposed can be changed as appropriate.

In the heat source unit 10, a heat-source-side control unit C1 that controls operations of each portion in the heat source unit 10 is disposed. The heat-source-side control unit C1 has various electric components for controlling each actuator, a communication module for communicating with other devices, and a microcomputer that includes an MPU and a memory. The heat-source-side control unit C1 is electrically connected to a plurality of sensors disposed in the heat source unit 10 and obtains the results of detection by the sensors. The heat-source-side control unit C1 is connected to a use-side control unit C2 described below such that communication is possible and cooperates with the use-side control unit C2 to constitute a controller CT that controls operations of the refrigeration cycle apparatus 1.

(2-2) Use Unit

Each use unit 30 includes a use-side heat exchanger 31, a use-side expansion valve 32, and a use-side fan 33. The use-side heat exchanger 31 is, for example, a fin-and-tube heat exchanger and causes heat exchange to be performed between air and refrigerant. Between the connection pipe CP1 on the liquid side and the connection pipe CP2 on the gas side, the use-side expansion valve 32 and the use-side heat exchanger 31 are connected in series. The use-side expansion valve 32 and the use-side heat exchanger 31 are disposed in this order from the connection pipe CP1 on the liquid side toward the connection pipe CP2 on the gas side. For each use-side heat exchanger 31, the use-side fan 33 is disposed. The use-side fan 33 generates in the use-side heat exchanger 31 an airflow for accelerating heat exchange. The plurality of use units 30 connected in parallel between the connection pipe CP1 on the liquid side and the connection pipe CP2 on the gas side constitute the use-side circuit RC2.

In each use unit 30, the use-side control unit C2 that controls operations of each portion in the use unit 30 is disposed. The use-side control unit C2 has various electric components for controlling each actuator, a communication module for communicating with other devices, and a microcomputer that includes an MPU and a memory. The use-side control unit C2 is connected to a sensor disposed in the use unit 30 and obtains the result of detection.

(2-3) Forward Cycle Operation

The refrigeration cycle apparatus 1 performs a forward cycle operation when cooling a target. In the forward cycle operation, the four-way valve 13 is controlled so as to be in a state where the first port and the second port communicate with each other and the third port and the fourth port communicate with each other (a state of the four-way valve 13 represented by solid lines in FIG. 3). In the forward cycle operation, the heat-source-side heat exchanger 14 functions as a radiator, and the use-side heat exchanger 31 functions as an evaporator. Refrigerant discharged from the compressor 11 circulates through the heat-source-side heat exchanger 14, the use-side expansion valve 32, and the use-side heat exchanger 31 sequentially to repeat a vapor compression refrigeration cycle that includes compression, condensation, expansion, and evaporation.

In the forward cycle operation, the operation frequency of the compressor 11 is controlled such that the evaporation pressure or the evaporation temperature in the use-side heat exchanger 31 is equal to a target pressure or a target evaporation temperature. Further, the opening degree of each use-side expansion valve 32 is controlled such that the degree of superheating of refrigerant that flows through the gas side of the use-side heat exchanger 31 is equal to a target degree of superheating. In the forward cycle operation, the first expansion valve 25*a* is controlled so as to be in a full-open state. In the forward cycle operation, the opening degree of the second expansion valve 25*b* is regulated such that the degree of superheating of refrigerant that exits from the subcooling heat exchanger 15 is equal to a target degree of superheating. Further, in the forward cycle operation, when a predetermined condition is satisfied, gas refrigerant having an intermediate pressure and subjected to heat exchange, in the subcooling heat exchanger 15, with refrigerant that flows between the branch point P1 and the high-pressure-side shutoff valve 21 is supplied from the injection port to a compression chamber, which is in the midst of compression, in a compression mechanism of the compressor 11. The compressor 11 supplied with the intermediate-pressure gas refrigerant can make the discharge temperature lower than in a case where gas refrigerant is not injected.

(2-4) Reverse Cycle Operation

The refrigeration cycle apparatus 1 performs a reverse cycle operation when heating a target. In the reverse cycle operation, the four-way valve 13 is controlled so as to be in a state where the first port and the fourth port communicate with each other and the second port and the third port communicate with each other (a state of the four-way valve 13 represented by dashed lines in FIG. 3). In the reverse cycle operation, the heat-source-side heat exchanger 14 functions as an evaporator, and the use-side heat exchanger 31 functions as a radiator. Refrigerant discharged from the compressor 11 circulates through the use-side heat exchanger 31, the first expansion valve 25*a*, and the heat-source-side heat exchanger 14 sequentially to repeat a vapor compression refrigeration cycle that includes compression, condensation, expansion, and evaporation.

In the reverse cycle operation, the second expansion valve 25*b* is controlled so as to be in a full-close state. In the reverse cycle operation, the operation frequency of the compressor 11 is controlled such that the condensation temperature in the use-side heat exchanger 31 is equal to a target condensation temperature. The opening degree of the use-side expansion valve 32 is controlled such that the degree of subcooling of refrigerant that flows through the liquid side of the use-side heat exchanger 31 is equal to a target degree of subcooling. The opening degree of the first expansion valve 25*a* is controlled such that the degree of superheating of refrigerant that flows through the gas side of the heat-source-side heat exchanger 14 is equal to a target degree of superheating.

(2-5) Additional Filling with Refrigerant

Figure 5:
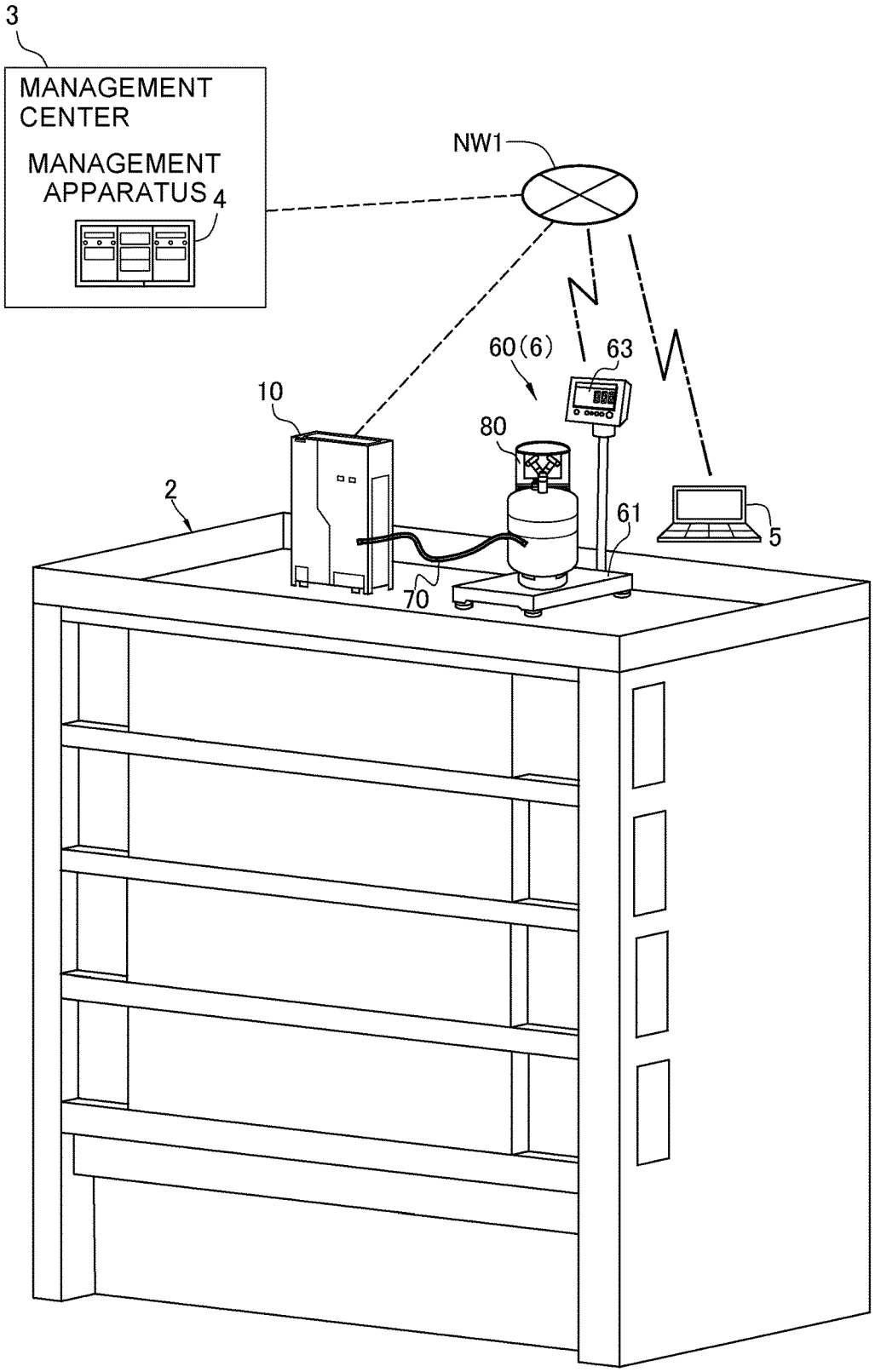
FIG. 5 is a schematic diagram illustrating an overview of an operation in which the refrigeration cycle apparatus is additionally filled with refrigerant.

FIG. 5 is a schematic diagram illustrating an overview of an operation in which the refrigeration cycle apparatus 1 is additionally filled with refrigerant.

Refrigerant that is used in the refrigeration cycle apparatus 1 is selected as appropriate in accordance with the engineering specifications or installation environment. In a case where, for example, the refrigeration cycle apparatus 1 is configured so as to be suitable for R410A refrigerant, any heat source unit 10 is configured so as to be suitable for R410A refrigerant. R410A refrigerant is mixed refrigerant that contains difluoromethane and pentafluoroethane. The refrigeration cycle apparatus 1 is designed to appropriately operate even if the mixture of difluoromethane and pentafluoroethane changes. In a case where the heat source unit 10 is additionally filled with refrigerant, the heat source unit 10 may be filled with R410A refrigerant or may be filled with difluoromethane or pentafluoroethane, which is an ingredient of R410A refrigerant. In other words, in a case where the refrigeration cycle apparatus 1 is suitable for mixed refrigerant, at the time of additional filling with refrigerant, the refrigeration cycle apparatus 1 may be refilled with the mixed refrigerant or may be refilled with refrigerant that is an ingredient of the mixed refrigerant.

Note that refrigerant that is used in the refrigeration cycle apparatus 1 is not limited to R410A refrigerant and may be another refrigerant. For example, R32 refrigerant may be used in the refrigeration cycle apparatus 1.

When the refrigeration cycle apparatus 1 is additionally filled with refrigerant, as illustrated in FIG. 5, the charge port 23 of the heat source unit 10 and the refrigerant container 80 are connected with each other by the charge hose 70. The charge hose 70 is a member for forming a flow path of refrigerant between the refrigerant container 80 and the refrigeration cycle apparatus 1. A manual valve of the refrigerant container 80 for supplying refrigerant and the charge port 23 of the heat source unit 10 are opened by an operator. The heat source unit 10 starts a forward cycle operation to drive the compressor 11, and refrigerant in the refrigerant container 80 is sent to the heat-source-side circuit RC1. The refrigerant flowing into the heat-source-side circuit RC1 via the charge port 23 passes through the accumulator 16 and is taken into the compressor 11. After the refrigeration cycle apparatus 1 has been filled with the refrigerant from the refrigerant container 80 in an amount equivalent to a target value of the additional filling amount, the manual valve of the refrigerant container 80 for supplying refrigerant and the charge port 23 are closed by the operator. The charge hose 70 is disconnected from the charge port 23, and the additional filling operation is completed.

Note that the operation for additional filling with refrigerant (additional filling operation) is performed by the operator in accordance with a predetermined construction procedure manual. The construction procedure manual specifies that when an additional filling operation is performed, the weight of the refrigerant container 80 from which refrigerant for additional filling is supplied is to be measured by using the measuring device 6 before and after additional filling. The construction procedure manual further specifies that when additional filling with refrigerant is performed, the operator is to transmit to the management apparatus 4 via the operator terminal 5 or the measuring device 6 information (report) for reporting the form in which the additional filling operation is performed. For example, the construction procedure manual specifies that the report is to include information regarding the refrigeration cycle apparatus 1 for which additional filling is performed (apparatus information), information for identifying the type of refrigerant for filling (refrigerant type identification information), and information correlating with the mass of the additional filling amount (mass correlation data).

The apparatus information includes information for identifying the refrigeration cycle apparatus 1. The apparatus information further includes information for identifying the operation state of the refrigeration cycle apparatus 1. For example, the "apparatus information" includes information for identifying the number of revolutions of the compressor 11 and information for identifying detection values obtained by various sensors. The apparatus information further includes at least any of information for identifying the specifics of the heat source unit 10 included in the refrigeration cycle apparatus 1, information for identifying the specifics of the connection pipes CP1 and CP2 included therein, and information for identifying the specifics of each use unit 30 included therein.

The "information for identifying the specifics of the heat source unit 10" is information for identifying at least any of, for example, the model or capacity (rated capacity) of the heat source unit 10, the air volume of the heat-source-side fan 20, and the capacity or form of the heat-source-side heat exchanger 14.

The "information for identifying the specifics of the connection pipes CP1 and CP2" is information for identifying at least any of, for example, the capacity, the diameter, the pipe length, and the level difference between the highest portion and the lowest portion of each of the connection pipes CP1 and CP2.

The "information for identifying the specifics of each use unit 30" is information for identifying at least any of, for example, the model or capacity (rated capacity) of the use unit 30, the air volume of the use-side fan 33, and the capacity or form of the use-side heat exchanger 31. The apparatus information further includes information for identifying the installation environment of the refrigeration cycle apparatus 1. The "information for identifying the installation environment" is not limited as long as the information for identifying the installation environment is information regarding the environment in which the refrigeration cycle apparatus 1 that is additionally filled with refrigerant is installed, and is, for example, information regarding the property (facility 2) in which the refrigeration apparatus that is additionally filled with refrigerant is installed. Further, for example, the "information for identifying the installation environment" is information for identifying the layout, the number of floors, the floor area, the installation form of the connection pipes CP1 and CP2, and so on in the facility 2. Here, the "installation form of the connection pipes CP1 and CP2" includes, for example, the length of each of the connection pipes CP1 and CP2 and/or the level difference between the highest portion and the lowest portion of each of the connection pipes CP1 and CP2.

The mass correlation data is data correlating with the mass of the refrigerant container 80 from which refrigerant is supplied to the refrigeration cycle apparatus 1 that is additionally filled with refrigerant. The mass correlation data includes information for identifying the weight of the refrigerant container 80. In other words, the mass correlation data includes information for identifying the weight of refrigerant corresponding to the additional filling amount. For example, the mass correlation data includes a value for identifying a change in the weight of the refrigerant container 80 between before and after the additional filling operation.

(3) Measuring Device

In the management system 100, the measuring device 6 is used to obtain the additional filling amount of refrigerant. In this embodiment, the measuring device 6 has a scale 60 illustrated in FIG. 5. As the scale 60, for example, a platform scale or a suspension scale is used. The scale 60 has a function of measuring the weight of the refrigerant container 80 and has a sufficient resolution for detecting the weight of refrigerant. The scale 60 wirelessly communicates with the management apparatus 4 via the communication network NW1. The scale 60 includes a scale storage unit M60, a weighing unit 61, a scale processing unit 62, a scale display unit 63, a scale input unit 64, and a scale communication unit 65 as main units.

The scale storage unit M60 stores various types of information and is constituted by, for example, a nonvolatile memory and a volatile memory. For example, the scale storage unit M60 stores a program for executing various functions of the scale 60. Further, for example, the scale storage unit M60 stores information transmitted from the management apparatus 4 and other devices.

The weighing unit 61 measures the weight of a target object put thereon. The weighing unit 61 has various mechanisms and various elements for measuring the weight of a target object put thereon. On the weighing unit 61, for example, the refrigerant container 80 from which refrigerant for additional filling is supplied is put.

The scale processing unit 62 has a microcomputer that includes an MPU, a memory, and so on. The scale processing unit 62 performs various processes in accordance with a command input to the scale input unit 64. The scale processing unit 62, for example, performs A/D conversion for the result of measurement by the weighing unit 61 and performs various calculations. The scale processing unit 62, for example, outputs the result of measurement by the weighing unit 61 via the scale display unit 63. The scale processing unit 62, for example, calculates a weight corresponding to the additional filling amount, which is the amount of refrigerant with which the refrigeration cycle apparatus 1 has been additionally filled, on the basis of the difference value between the weight of the refrigerant container 80 before additional filling and the weight of the refrigerant container 80 after additional filling and displays the calculated value on the scale display unit 63, in accordance with command input by the operator.

The scale processing unit 62, for example, transmits a report to the management apparatus 4 in accordance with command input by the operator. More specifically, the scale processing unit 62 includes a creation unit 621 and a transmission unit 622. The creation unit 621 creates a report that includes any of data (mass correlation data) including the result of measurement by the measuring device 6, apparatus information, and refrigerant type identification information on the basis of input by the operator. The transmission unit 622 transmits the report created by the creation unit 621 to the management apparatus 4 via the scale communication unit 65 in accordance with command input by the operator.

The scale display unit 63 displays various types of information. The scale display unit 63, for example, displays an input screen for inputting various commands. For example, the scale display unit 63 displays the result of weighing by the weighing unit 61. The scale display unit 63 displays, for example, the result of calculation of a weight corresponding to the additional filling amount obtained by the scale processing unit 62.

The scale input unit 64 is an interface for inputting various types of information. For example, a terminal input unit 52 is implemented as physical keys and/or a touch screen. To the scale input unit 64, for example, a command for creating and transmitting to the management apparatus 4 a report is input by the operator. The command includes a command for inputting or specifying apparatus information, refrigerant type identification information, and/or mass correlation data, which are the contents of the report to be transmitted to the management apparatus 4.

The scale communication unit 65 has a communication module and an antenna for transmitting and receiving data to and from the management apparatus 4 via the communication network NW1.

(4) Operator Terminal

Now, the operator terminal 5 is described. The operator terminal 5 is an information processing device that is carried by an operator who performs an additional filling operation of filling the refrigeration cycle apparatus 1 with refrigerant. As the operator terminal 5, for example, a mobile terminal, such as a smartphone or a tablet PC, or a laptop personal computer is assumed; however, the operator terminal 5 may be another type of information processing device. The operator terminal 5 wirelessly communicates with the management apparatus 4 via the communication network NW1. In the operator terminal 5, an application for implementing data input and data output related to communication with the management apparatus 4 is installed.

The operator terminal 5 has a terminal storage unit 51, a terminal input unit 52, a terminal output unit 53, a terminal processing unit 54, and a terminal communication unit 55.

The terminal storage unit 51 stores various types of information and is constituted by, for example, a nonvolatile memory and a volatile memory. For example, the terminal storage unit 51 stores a program for executing various functions of the operator terminal 5. Further, for example, the terminal storage unit 51 stores information transmitted from the management apparatus 4 and other devices.

The terminal input unit 52 is an interface for inputting various types of information. For example, the terminal input unit 52 is implemented as, for example, a keyboard, a mouse, and/or a touch screen. To the terminal input unit 52, for example, a command for creating and transmitting to the management apparatus 4 a report is input by the operator. The command includes a command for inputting or specifying apparatus information, refrigerant type identification information, and/or mass correlation data, which are the contents of the report to be transmitted to the management apparatus 4.

The terminal output unit 53 outputs various types of information. The terminal output unit 53 includes a display and displays information. The terminal output unit 53, for example, displays an input screen for inputting various commands. The terminal output unit 53 includes a speaker and outputs voice information.

The terminal processing unit 54 performs various types of information processing in the operator terminal 5. The terminal processing unit 54, for example, transmits various types of data to the management apparatus 4 via the terminal communication unit 55. The terminal processing unit 54 stores data received via the terminal communication unit 55 in the terminal storage unit 51. The terminal processing unit 54 outputs information received from the management apparatus 4 via the terminal output unit 53. Further, the terminal processing unit 54, for example, transmits a report to the management apparatus 4 in accordance with command input by the operator. More specifically, the terminal processing unit 54 includes a creation unit 541 and a transmission unit 542. The creation unit 541 creates a report that includes any of data (mass correlation data) including the result of measurement by the measuring device 6, apparatus information, and refrigerant type identification information on the basis of input by the operator. The transmission unit 542 transmits the report created by the creation unit 541 to the management apparatus 4 via the terminal communication unit 55 in accordance with command input by the operator.

The terminal communication unit 55 includes a communication module for a connection with the communication network NW1. The terminal communication unit 55 communicates with the management apparatus 4 via the communication network NW1.

(5) Management Apparatus

Now, the management apparatus 4 is described. The management apparatus 4 has a storage unit 41, an input unit 42, a communication unit 43, a processing unit 44, and an output unit 45.

The storage unit 41 stores various types of information and includes, for example, a ROM, a RAM, and/or a hard disk. The storage unit 41 stores a program for executing various functions of the management apparatus 4. The storage unit 41 includes a first storage unit 41A, a second storage unit 41B, a third storage unit 41C, a fourth storage unit 41D, a fifth storage unit 41E, and a sixth storage unit 41F.

The first storage unit 41A individually stores information related to a plurality of refrigeration cycle apparatuses 1 managed by the management apparatus 4. The first storage unit 41A, for example, stores information regarding the facility 2 in which each refrigeration cycle apparatus 1 is installed and information regarding the refrigeration cycle apparatus 1 that is installed in each facility 2. Further, the first storage unit 41A, for example, individually stores information regarding the model, capacity, installation form, and so on of each of the heat source unit 10, the use units 30, and the connection pipes CP1 and CP2 included in each refrigeration cycle apparatus 1.

The second storage unit 41B individually stores various types of information transmitted from the refrigeration cycle apparatuses 1 in association with the refrigeration cycle apparatuses 1.

The third storage unit 41C individually stores various types of information transmitted from the operator terminal 5 or the measuring device 6. The third storage unit 41C, for example, stores apparatus information, refrigerant type identification information, and mass correlation data included in a report transmitted from the operator terminal 5 or the measuring device 6. In the third storage unit 41C, corresponding apparatus information, refrigerant type identification information, and mass correlation data are associated with one another and stored.

The fourth storage unit 41D ("initial-filling-amount storage unit") individually stores the amount of refrigerant (initial filling amount) with which each refrigeration cycle apparatus 1 is filled before additional filling in association with information for identifying the refrigeration cycle apparatus 1.

The fifth storage unit 41E ("additional-filling-amount storage unit") individually stores the additional filling amount of each refrigeration cycle apparatus 1 in association with corresponding apparatus information.

The sixth storage unit 41F individually stores the refrigerant filling amount (the sum of the initial filling amount and the additional filling amount) of each refrigeration cycle apparatus 1 in association with information for identifying the refrigeration cycle apparatus 1.

Note that the storage unit 41 includes a storage unit other than the above-described storage units and can store any information.

The input unit 42 is an interface for inputting information to the management apparatus 4. For example, the input unit 42 is implemented as, for example, a keyboard, a mouse, and/or a touch screen. The administrator can input various commands via the input unit 42.

The communication unit 43 is an interface for communicating with other devices via the communication network NW1. The communication unit 43 includes a communication module and electric components for a connection with the communication network NW1. The communication unit 43, for example, receives various types of information from the refrigeration cycle apparatuses 1. The communication unit 43, for example, receives a report from the operator terminal 5 or the measuring device 6. Information received by the communication unit 43 is stored in the storage unit 41 as appropriate.

The processing unit 44 is a functional unit that performs various types of information processing in the management apparatus 4. The processing unit 44 includes an MPU, a cache memory, and so on. The processing unit 44 has an obtaining unit 441, a calculation unit 442. and an information creation unit 443.

The obtaining unit 441 ("additional-filling-amount obtaining unit") obtains various types of information from the communication network NW1 via the communication unit 43. For example, when receiving a report transmitted from the operator terminal 5 or the measuring device 6, the obtaining unit 441 stores mass correlation data and corresponding apparatus information and refrigerant type identification information in the third storage unit 41C in association with each other.

The calculation unit 442 performs various calculations regarding processing by the management apparatus 4. For example, in response to reception of mass correlation data from the operator terminal 5 or the scale 60, the calculation unit 442 calculates the amount of refrigerant (additional filling amount), corresponding to the mass correlation data, with which the refrigeration cycle apparatus 1 has been additionally filled. Specifically, the calculation unit 442 calculates the additional filling amount, which is the amount of refrigerant with which the refrigeration cycle apparatus 1 has been additionally filled, on the basis of the type of refrigerant identified with the refrigerant type identification information and the result of weighing by the weighing unit 61 identified with the mass correlation data. The calculation unit 442 stores the calculated additional filling amount in the fifth storage unit 41E in association with the corresponding apparatus information. Accordingly, the additional filling amount, which is the amount of refrigerant with which the refrigeration cycle apparatus 1 has been additionally filled, can be managed.

The information creation unit 443 ("useful-information creation unit") creates predetermined useful information in accordance with an input command input to the input unit 42 or a request transmitted from other devices. The "useful information" is information that is used in management of the amount of refrigerant. The useful information is, for example, information that is used by the administrator to determine whether the additional filling amount, which is the amount of refrigerant with which the refrigeration cycle apparatus 1 has been additionally filled, is appropriate. The useful information is, for example, a report that is presented to the administrator regarding whether the additional filling amount, which is the amount of refrigerant with which the refrigeration cycle apparatus 1 has been additionally filled, is appropriate. The useful information is, for example, information indicating, the average additional filling amount in a property similar to the refrigeration cycle apparatus 1 that has been additionally filled with refrigerant and the like. The information creation unit 443, for example, creates useful information on the basis of the additional filling amount regarding one refrigeration cycle apparatus 1 and the additional filling amount regarding another refrigeration cycle apparatus 1. Further, for example, when creating useful information, the information creation unit 443 uses various types of information included in apparatus information.

The output unit 45 outputs various types of information. The output unit 45 includes a display that displays information. For example, the output unit 45 outputs, an input screen for accepting input of various types of information and the like.

(6) Flow of Processes in Management System

Figure 6:
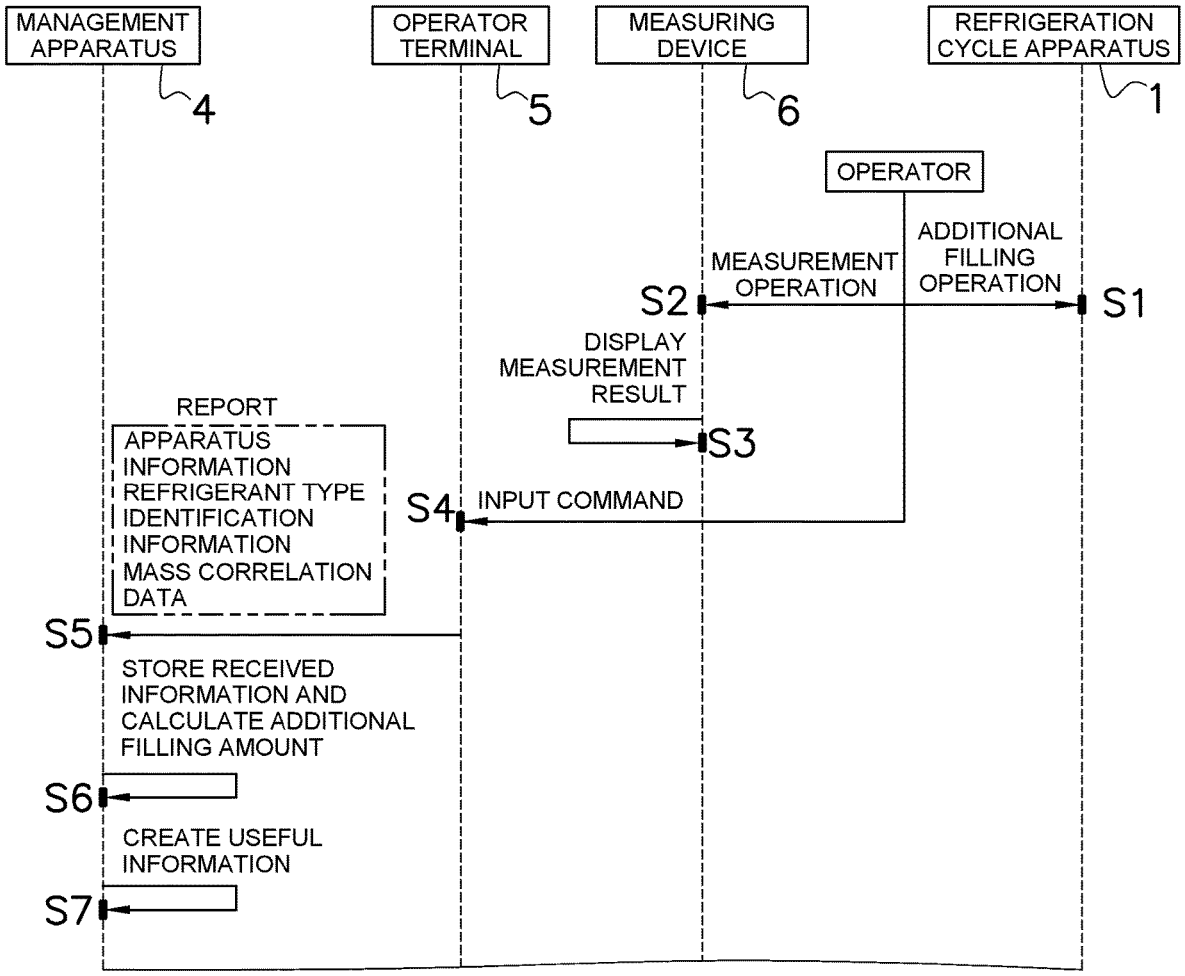
FIG. 6 is a schematic diagram illustrating an example flow of processes in the management system.
Figure 7:
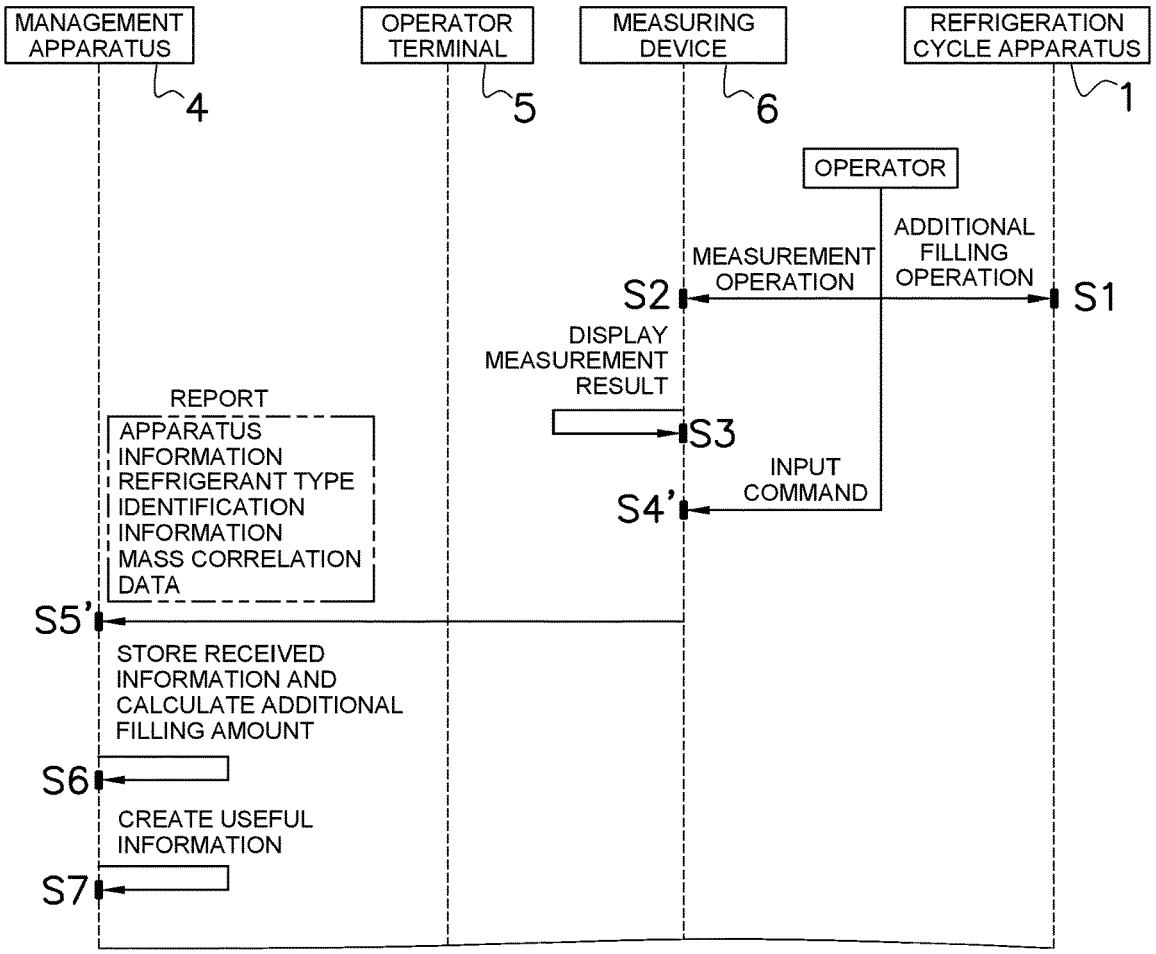
FIG. 7 is a schematic diagram illustrating an example flow of processes in the management system.

FIG. 6 and FIG. 7 are schematic diagrams illustrating example flows of processes in the management system 100. FIG. 6 illustrates an example where a report is transmitted from the operator terminal 5 to the management apparatus 4. FIG. 7 illustrates an example where a report is transmitted from the measuring device 6 to the management apparatus 4. Steps S1 to S3 and steps S6 and S7 in FIG. 6 and FIG. 7 are common steps. Note that the flows of processes illustrated in FIG. 6 and FIG. 7 are examples and can be changed as appropriate. For example, another step not illustrated may be inserted before or after each step.

In the management system 100, after the refrigeration cycle apparatus 1 has been installed, an additional filling operation with refrigerant is performed by the operator (step S1). Simultaneously with the additional filling operation with refrigerant, a measurement operation is performed by the operator (step S2). In the measurement operation, a weight correlating with the amount of refrigerant for additional filling is measured. Specifically, in the measurement operation, the refrigerant container 80 from which refrigerant for additional filling is supplied is put on the weighing unit 61 of the scale 60.

The measuring device 6 displays the weight of the refrigerant container 80 as the measurement result during the additional filling operation (step S3). Further, the measuring device 6 calculates a weight corresponding to the additional filling amount on the basis of the difference value between the weight of the refrigerant container 80 before the start of additional filling and the weight of the refrigerant container 80 after completion of additional filling and displays the calculated value on the scale display unit 63 as the measurement result.

The operator who has completed the additional filling operation inputs to the operator terminal 5 or the measuring device 6 a command for creating a report as appropriate and transmitting the report to the management apparatus 4 (S4 in FIG. 6, S4' in FIG. 7).

In response to input of the command by the operator, the operator terminal 5 or the measuring device 6 transmits a corresponding report (apparatus information, refrigerant type identification information, and mass correlation data) to the management apparatus 4 (S5 in FIG. 6, S5' in FIG. 7).

When receiving the report from the operator terminal 5 or the measuring device 6, the management apparatus 4 stores the apparatus information, the refrigerant type identification information, and the mass correlation data included in the report in association with one another, and calculates and stores the additional filling amount, which is the amount of refrigerant with which the refrigeration cycle apparatus 1 has been filled in the additional filling operation (step S6).

The management apparatus 4 creates useful information as needed on the basis of the contents of the received report (step S7).

(7) Features (7-1)

The management system 100 according to this embodiment is a system for managing the amount of refrigerant with which each of the large number of refrigeration cycle apparatuses 1 each having the refrigerant circuit RC is filled. The management system 100 includes the obtaining unit 441, the fifth storage unit 41E, the information creation unit 443, and so on. The obtaining unit 441 obtains the additional filling amount, which is the amount of refrigerant with which a refrigeration cycle apparatus 1, among the refrigeration cycle apparatuses 1, after installation has been additionally filled. The fifth storage unit 41E stores apparatus information that is information regarding the refrigeration cycle apparatus 1 that has been additionally filled with refrigerant and the additional filling amount regarding the refrigeration cycle apparatus 1 identified with the apparatus information in association with each other. The information creation unit 443 creates useful information to be used in management of the amount of refrigerant on the basis of the additional filling amount regarding one of the refrigeration cycle apparatuses 1 and the additional filling amount regarding another of the refrigeration cycle apparatuses 1.

Accordingly, regarding additional filling of the refrigeration apparatus with refrigerant performed at the construction site, it is possible to manage the additional filling amount of the refrigeration apparatus. Specifically, when the created useful information is used, it is possible to determine whether the amount of refrigerant with which additional filling has been performed is appropriate.

(7-2)

In this embodiment, the fourth storage unit 41D included in the management system 100 stores the initial filling amount, which is the amount of refrigerant before additional filling, regarding the refrigeration cycle apparatus 1. Accordingly, it is possible to manage the additional filling amount in association with the initial filling amount.

(7-3)

In this embodiment, the apparatus information includes information for identifying the installation environment of the refrigeration cycle apparatus 1 that has been additionally filled with refrigerant. Accordingly, it is possible to manage the additional filling amount in association with the installation environment.

(7-4)

In this embodiment, the apparatus information includes information for identifying the capacity of each of the connection pipes CP1 and CP2 of the refrigeration cycle apparatus 1 that has been additionally filled with refrigerant and/or the specifics of each use unit 30 thereof. Accordingly, it is possible to manage the additional filling amount in association with the capacity of each of the connection pipes CP1 and CP2 of the refrigeration cycle apparatus 1 that has been additionally filled with refrigerant and/or the specifics of each use unit 30 thereof (for example, the capacity, the air volume, or the capacity or form of the heat exchanger).

(7-5)

In this embodiment, the obtaining unit 441, the fifth storage unit 41E, and the information creation unit 443 are disposed at a remote site away from the installation place of the refrigeration cycle apparatus 1. Accordingly, remote management is possible for the amount of refrigerant with which the refrigeration apparatus has been additionally filled.

(7-6)

The management system 100 in this embodiment can be constituted only by the management apparatus 4. However, in addition to the management apparatus 4, the management system 100 may include any or all of the operator terminal 5, the measuring device 6, the refrigeration cycle apparatuses 1, and other devices as a constituent element or constituent elements of the management system 100.

(8) Modifications

The above-described embodiment can be modified as appropriate as indicated by the following modifications. Note that each modification may be applied by combining with other modifications as long as no contradiction arises.

(8-1) Modification 1

In the above-described embodiment, functional units including the obtaining unit 441, the fourth storage unit 41D, the fifth storage unit 41E, the information creation unit 443, and so on are included in the management apparatus 4 disposed at a remote site away from the installation place of the refrigeration cycle apparatus 1. However, any of the functional units (41A to 41F, 441, 442, 443, and so on) included in the management apparatus 4 may be included in a local device different from the management apparatus 4. In other words, any or all of the functional units including the obtaining unit 441, the fourth storage unit 41D, the fifth storage unit 41E, the information creation unit 443, and so on may be included in a device that is disposed in the installation place of the refrigeration cycle apparatus 1.

(8-2) Modification 2

In the above-described embodiment, the management apparatus 4 is disposed in the management center 3 but may be disposed in another place. For example, the management apparatus 4 may be disposed in the facility 2.

Further, for example, the management apparatus 4 need not be constituted as one device and may be configured to implement the functional units (41, 41A to 41F, 42, 43, 44, 45, 441, 442, and 443) by connecting a plurality of devices over a network. In such a case, the devices that constitute the management apparatus 4 may be separately disposed at different locations. For example, any of the controller CT, the operator terminal 5, the measuring device 6, devices disposed in the management center 3, and other devices may be combined to constitute the management apparatus 4.

(8-3) Modification 3

In the above-described embodiment, a description is given under the assumption that the communication network NW1 includes a Wide Area Network (WAN) that extends over a plurality of properties; however, the configuration form of the communication network NW1 can be changed as appropriate. For example, the communication network NW1 may be constituted only by a Local Area Network (LAN). In other words, the communication network NW1 may be formed in the data link layer of the OSI reference model.

(8-4) Modification 4

The above-described embodiment states that the operator terminal 5 and the measuring device 6 are connected to the communication network NW1 by wireless communication. However, the operator terminal 5 and/or the measuring device 6 may be connected to the communication network NW1 by wired communication. For example, the operator terminal 5 and/or the measuring device 6 may be connected to the controller CT or another communication device by a communication cable, thereby being connected to the communication network NW1.

(8-5) Modification 5

In the above-described embodiment, the operator terminal 5 and the measuring device 6 individually access the communication network NW1. However, the operator terminal 5 and the measuring device 6 may be configured to be accessible to the communication network NW1 by one of the operator terminal 5 or the measuring device 6 being connected to the other. In other words, one of the operator terminal 5 or the measuring device 6 may access the communication network NW1 via the other.

(8-6) Modification 6

In the above-described embodiment, apparatus information is transmitted from the operator terminal 5 or the measuring device 6 to the management apparatus 4. However, apparatus information may be transmitted from other devices. For example, apparatus information may be transmitted from the controller CT of the refrigeration cycle apparatus 1. Further, apparatus information may be input to the management apparatus 4 via the input unit 42.

(8-7) Modification 7

Information included in apparatus information is not limited to those illustrated in the above-described embodiment and can be changed as appropriate in accordance with the installation environment or engineering specifications.

(8-8) Modification 8

Useful information created by the information creation unit 443 is not limited to those illustrated in the above-described embodiment and can be changed as appropriate in accordance with the installation environment or engineering specifications.

(8-9) Modification 9

In the above-described embodiment, the measuring device 6 has functional units including the scale communication unit 65, the scale input unit 64, and so on. However, the measuring device 6 need not have all of the functional units 61 to 65. For example, the measuring device 6 need not have a communication function, and the scale communication unit 65 may be omitted. Further, for example, the measuring device 6 need not have the scale input unit 64.

In a case where the measuring device 6 is a weighing instrument having no communication function, the scale processing unit 62 can be omitted as appropriate. In such a case, the operator may transmit data obtained by capturing an image of the result of measurement displayed on the scale display unit 63 to the management apparatus 4 from the operator terminal 5 as mass correlation data.

(8-10) Modification 10

The above-described embodiment states that the measuring device 6 and the operator terminal 5 are separate devices. However, the measuring device 6 and the operator terminal 5 need not be separate devices, and the operator terminal 5 may be included in the measuring device 6.

(8-11) Modification 11

In the above-described embodiment, in a measurement operation at the time of additional filling with refrigerant, the refrigerant container 80 from which refrigerant for additional filling is supplied is put on the weighing unit 61 of the scale 60 to thereby measure the weight of the refrigerant container 80, and the additional filling amount, which is the amount of refrigerant with which the refrigeration cycle apparatus 1 has been additionally filled, is determined. However, the form in which the additional filling amount is measured need not be limited to this and can be changed as appropriate.

For example, the heat source unit 10 may be put on the weighing unit 61 of the scale 60, and a weight corresponding to the additional filling amount may be measured on the basis of the difference value between the weight of the heat source unit 10 before additional filling and the weight of the heat source unit 10 after additional filling.

Figure 8:
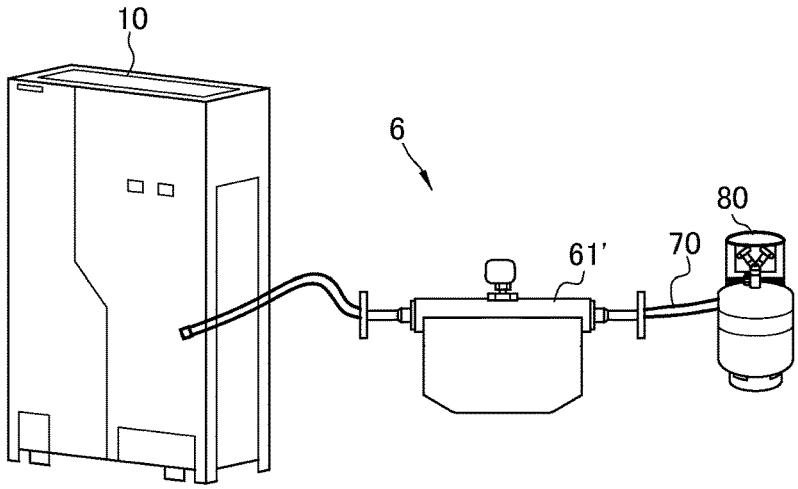
FIG. 8 is a schematic diagram illustrating a flow rate measurement unit according to Modification 10.

Further, for example, instead of the weighing unit 61 that measures a weight, the measuring device 6 may have a flow rate measurement unit 61' as illustrated in FIG. 8. FIG. 8 illustrates a state where the flow rate measurement unit 61' is disposed on the charge hose 70 that connects the heat source unit 10 and the refrigerant container 80 with each other. In such a case, at the time of additional filling with refrigerant, the flow rate of refrigerant that is supplied from the refrigerant container 80 to the heat source unit 10 is measured by the flow rate measurement unit 61', and the additional filling amount is calculated on the basis of the measurement value. The result of measurement by the flow rate measurement unit 61' is transmitted to the management apparatus 4 from the measuring device 6, the operator terminal 5, or another device as mass correlation data.

(8-12) Modification 12

Further, for example, a liquid level sensor for measuring the liquid level of refrigerant encapsulated in the refrigerant container 80 may be disposed in the refrigerant container 80 and a value obtained by the liquid level sensor may be used to calculate the additional filling amount. Specifically, on the basis of the difference value between the liquid level of refrigerant in the refrigerant container 80 before an additional filling operation and that after completion of the additional filling operation, the additional filling amount, which is the amount of refrigerant with which the refrigeration cycle apparatus 1 has been additionally filled, may be determined. In such a case, a detection value obtained by the liquid level sensor may be transmitted to the management apparatus 4 from, for example, the controller CT or the operator terminal 5 as mass correlation data.

(8-13) Modification 13

In the above-described embodiment, the management apparatus 4 (calculation unit 442) calculates the additional filling amount, which is the amount of refrigerant with which the refrigeration cycle apparatus 1 has been additionally filled, on the basis of mass correlation data transmitted from the operator terminal 5 or the measuring device 6. However, the additional filling amount may be calculated by a device other than the management apparatus 4. For example, the operator terminal 5 or the measuring device 6 may calculate the additional filling amount on the basis of the result of measurement by the measuring device 6 and transmit the calculated value to the management apparatus 4. In such a case, for example, the additional filling amount may be calculated by, for example, the terminal processing unit 54 of the operator terminal 5 or the scale processing unit 62 of the measuring device 6.

(8-14) Modification 14

The above-described embodiment states that the obtaining unit 441 of the management apparatus 4 is the "additional-filling-amount obtaining unit" that obtains mass correlation data from the operator terminal 5 or the measuring device 6. However, from a different point of view, the measuring device 6 directly obtains information corresponding to the additional filling amount, which is the amount of refrigerant with which the refrigeration cycle apparatus 1 has been filled in an additional filling operation, and therefore, the measuring device 6 can be considered to be the "additional-filling-amount obtaining unit" that obtains the additional filling amount, which is the amount of refrigerant with which the refrigeration cycle apparatus 1 has been filled in an additional filling operation.

(8-15) Modification 15

In the above-described embodiment, the controller CT is configured in which the heat-source-side control unit C1 and the use-side control unit C2 are connected to each other such that communication is possible and cooperate with each other to control operations of the refrigeration cycle apparatus 1. However, the configuration form of the controller CT of the refrigeration cycle apparatus 1 need not be limited to this and can be changed as appropriate. For example, a remote controller not illustrated may be included as a constituent device of the controller CT. Further, a central management device (not illustrated) that transmits commands to a plurality of refrigeration cycle apparatuses 1 may be included as a constituent device of the controller CT.

(8-16) Modification 16

The configuration form of the refrigerant circuit RC described in the above-described embodiment can be changed as appropriate. For example, the refrigerant circuit RC may include a device not illustrated in FIG. 3. Further, for example, any of the devices illustrated in FIG. 3 as a constituent device of the refrigerant circuit RC may be omitted.

Additional Statement

Although an embodiment has been described above, it should be understood that various changes can be made to the forms and details without departing from the spirit and scope stated in the claims.

INDUSTRIAL APPLICABILITY

The present disclosure can be used in a refrigerant amount management system.

What is claimed is:

1. A refrigerant amount management system for managing an amount of refrigerant with which each of a plurality of refrigeration cycle apparatuses is filled, each refrigeration cycle apparatus having a refrigerant circuit, the refrigerant amount management system comprising:

a processor including an additional-filling amount obtaining unit and a useful-information creation unit; and a computer storage including a storage unit;

the additional-filling-amount obtaining unit being configured to obtain an additional filling amount, the additional filling amount being an amount of refrigerant with which a refrigeration cycle apparatus of the plurality of refrigeration cycle apparatuses has been additionally filled after installation;

the storage unit being configured to store apparatus information regarding the refrigeration cycle apparatus that has been additionally filled with refrigerant and the additional filling amount of the refrigeration cycle apparatus identified with the apparatus information in association with each other; and the useful-information creation unit being configured to create useful information to be used in management of the amount of refrigerant based on the additional filling amount of the refrigeration cycle apparatus and an additional filling amount of another of the refrigeration cycle apparatuses.

2. The refrigerant amount management system according to claim 1, wherein the computer storage further includes an initial-filling-amount storage unit, contained in the refrigeration cycle apparatus configured to store an initial filling amount, the initial filling amount being an amount of refrigerant before the initial-filling-amount storage unit additional filling of the refrigeration cycle apparatus.

3. The refrigerant amount management system according to claim 1, wherein the apparatus information includes information usable to identify an installation environment of the refrigeration cycle apparatus that has been additionally filled with refrigerant.

4. The refrigerant amount management system according to claim 1, wherein the apparatus information includes information usable to identify at least one of a capacity of a connection pipe connected to a heat source unit of the refrigeration cycle apparatus that has been additionally filled with refrigerant and specifics of a use unit of the refrigeration cycle apparatus that has been additionally filled with the refrigerant.

5. The refrigerant amount management system according to claim 1, wherein at least one of the additional-filling-amount obtaining unit, the storage unit, and the useful-information creation unit is disposed at a remote site away from an installation place of the refrigeration cycle apparatus.

6. The refrigerant amount management system according to claim 2, wherein the apparatus information includes information usable to identify an installation environment of the refrigeration cycle apparatus that has been additionally filled with refrigerant.

7. The refrigerant amount management system according to claim 2, wherein the apparatus information includes information usable to identify at least one of a capacity of a connection pipe connected to a heat source unit of the refrigeration cycle apparatus that has been additionally tilled with refrigerant and specifics of a use unit of the refrigeration cycle apparatus that has been additionally filled with the refrigerant.

8. The refrigerant amount management system according to claim 2, wherein at least one of the additional-filling-amount obtaining unit, the storage unit, and the useful-information creation unit is disposed at a remote site away from an installation place of the refrigeration cycle apparatus.

9. The refrigerant amount management system according to claim 3, wherein the apparatus information includes information usable to identify at least one of a capacity of a connection pipe connected to a heat source unit of the refrigeration cycle apparatus that has been additionally tilled with refrigerant and specifics of a use unit of the refrigeration cycle apparatus that has been additionally filled with the refrigerant.

10. The refrigerant amount management system according to claim 3, wherein at least one of the additional-filling-amount obtaining unit, the storage unit, and the useful-information creation unit is disposed at a remote site away from an installation place of the refrigeration cycle apparatus.

11. The refrigerant amount management system according to claim 4, wherein at least one of the additional-filling-amount obtaining unit, the storage unit, and the useful-information creation unit is disposed at a remote site away from an installation place of the refrigeration cycle apparatus.

* * * * *